US008640876B2

(12) United States Patent
Danov

(10) Patent No.: US 8,640,876 B2
(45) Date of Patent: Feb. 4, 2014

(54) METHOD FOR SEPARATING RICH ORE PARTICLES FROM AGGLOMERATES WHICH CONTAIN SAID RICH ORE PARTICLES OF VALUE AND MAGNETIZABLE PARTICLES ATTACHED THERETO, ESPECIALLY $FE_3O_4$

(75) Inventor: Vladimir Danov, Erlangen (DE)

(73) Assignees: Siemens Aktiengesellschaft, Munich (DE); BASF SE, Ludwigshafen (DE)

( * ) Notice: Subject to any disclaimer, the term of this patent is extended or adjusted under 35 U.S.C. 154(b) by 194 days.

(21) Appl. No.: 13/119,109

(22) PCT Filed: Jul. 22, 2009

(86) PCT No.: PCT/EP2009/059397

§ 371 (c)(1),
(2), (4) Date: Mar. 15, 2011

(87) PCT Pub. No.: WO2010/031619

PCT Pub. Date: Mar. 25, 2010

(65) Prior Publication Data

US 2011/0171113 A1 Jul. 14, 2011

(30) Foreign Application Priority Data

Sep. 18, 2008 (DE) ..... 10 2008 047 853

(51) Int. Cl.
*B03B 9/06* (2006.01)

(52) U.S. Cl.
USPC ..... 209/11; 209/8; 423/25

(58) Field of Classification Search
USPC ..... 209/8; 423/139
See application file for complete search history.

(56) References Cited

U.S. PATENT DOCUMENTS

| | | | | |
|---|---|---|---|---|
| 1,937,413 | A | 11/1933 | Roth | |
| 2,423,314 | A * | 7/1947 | Herkenhoff | 209/8 |
| 2,765,075 | A | 10/1956 | Goodwin | 209/40 |
| 4,657,666 | A * | 4/1987 | Snook et al. | 209/8 |
| 2003/0226920 | A1 | 12/2003 | Yanase | 241/171 |
| 2004/0079262 | A1 | 4/2004 | Hornung et al. | 110/246 |

FOREIGN PATENT DOCUMENTS

| | | | | |
|---|---|---|---|---|
| CN | 101032708 | A * | 9/2007 | |
| DE | 1433359 | | 1/1969 | |
| DE | 69026949 | T2 | 11/1996 | A61K 49/00 |
| EP | 1217318 | A1 | 6/2002 | F27B 7/18 |
| WO | 02/066168 | A1 | 8/2002 | B03D 1/16 |
| WO | WO 2008061305 | A1 * | 5/2008 | |

OTHER PUBLICATIONS

International PCT Search Report, PCT/EP2009/059397, 14 pages.

* cited by examiner

*Primary Examiner* — Melvin C Mayes
*Assistant Examiner* — Melissa Stalder
(74) *Attorney, Agent, or Firm* — King & Spalding L.L.P.

(57) ABSTRACT

In a method for separating rich ore particles from agglomerates which contain said rich ore particles and magnetizable particles attached thereto, especially Fe3O4, in the course of a process for obtaining rich ore from crude ore, in which agglomerates the rich ore particle and the magnetizable particle are bonded by organic molecular chains, the agglomerates are contained in a suspension containing a carrier fluid and are broken up by an input of mechanical energy so that an agent contained in the suspension and decomposing the exposed, hydrophobic molecular chains can act upon the molecular chains. The Fe-containing oxide components are separated from the suspension in a magnetic separation process.

7 Claims, 1 Drawing Sheet

METHOD FOR SEPARATING RICH ORE PARTICLES FROM AGGLOMERATES WHICH CONTAIN SAID RICH ORE PARTICLES OF VALUE AND MAGNETIZABLE PARTICLES ATTACHED THERETO, ESPECIALLY $FE_3O_4$

CROSS-REFERENCE TO RELATED APPLICATIONS

This application is a U.S. National Stage Application of International Application No. PCT/EP2009/059397 filed Jul. 22, 2009, which designates the United States of America, and claims priority to DE Application No. 10 2008 047 853.9 filed Sep. 18, 2008. The contents of which are hereby incorporated by reference in their entirety.

TECHNICAL FIELD

The invention relates to a method for separating ore particles of value, especially $Cu_2S$, from agglomerates which contain ore particles of value and magnetizable particles attached thereto, especially $Fe_3O_4$, in the course of a process for extracting the ore of value from crude ore, within which agglomerates the ore of value and the magnetizable particles are bonded by way of organic molecular chains.

BACKGROUND

Suitable magnetizable particles are referred to hereafter by way of example as "$Fe_3O_4$", which is intended in a representative sense and also includes other suitable compounds or alloys. Suitable ores of value are referred to hereafter by way of example as $Cu_2S$, which is intended in a representative sense and also includes other ores of value.

Ores of value, such as for example copper sulfide ($Cu_2S$), are obtained by way of ore extraction. In order to separate the copper sulfide from the ore, the ore is first finely ground until it is in a virtually pulverulent form. Subsequently, in order to make magnetic separation of the $Cu_2S$ possible, magnetite ($Fe_3O_4$) and agents containing other chemical additives which have a hydrophobizing effect on the $Cu_2S$ and the $Fe_3O_4$ are added to the ore. This hydrophobization occurs as a result of the longer organic molecular chains that are contained in the additives and selectively become attached to the $Cu_2S$ or the $Fe_3O_4$. The latter are consequently surrounded with a water-repellent shell. These organic molecular chains then bring about an organic bond between the $Cu_2S$ and the magnetite, so as to produce $Cu_2S/Fe_3O_4$ agglomerates that are magnetic (unlike pure $Cu_2S$) and, as a result, can be separated from the rest of the fine powder, which substantially contains sand, by means of magnets. This means that these $Cu_2S/Fe_3O_4$ particles can be extracted as a whole from the remaining material. Since, however, the $Cu_2S$ and $Fe_3O_4$ particles are of a size that is in the μm range, they have a tendency to agglomerate, that is to say that relatively large, cluster-like agglomerates form from one or more $Cu_2S$ particles and a multitude of $Fe_3O_4$ particles, the $Cu_2S$ particles being bonded to the $Fe_3O_4$ particles by way of the organic molecular chains. Within this particle agglomerate, the $Cu_2S$ particles are enclosed virtually completely by $Fe_3O_4$ particles; the organic molecular chains are situated between the $Fe_3O_4$ particles and the $Cu_2S$ particles. So, to be able to separate the pure $Cu_2S$, it is necessary to break up this organic bond and to obtain the individual particles again, so that the $Fe_3O_4$ can once again be mechanically separated from the $Cu_2S$. This has previously been performed by chemical means, that is to say it is attempted to break down the molecular chains by a suitable chemical process. As a result of the virtually complete enclosure of the $Cu_2S$ particles with $Fe_3O_4$ particles, there is the problem that the agents that are intended to react with the organic molecular chains can scarcely come into contact with these organic bonds for which reason the particle separation that can be achieved in this way is only relatively low.

SUMMARY

According to various embodiments, a method can be provided which makes it possible to obtain better separation of the ore particles of value and magnetizable particles that are bonded as a result of hydrophobization.

According to an embodiment, in a method for separating ore particles of value from agglomerates which contain ore particles of value and magnetizable particles attached thereto, especially $Fe_3O_4$, in the course of a process for extracting the ore of value from crude ore, within which agglomerates the ore particles of value and the magnetizable particles are bonded by way of organic molecular chains, the agglomerates undergo both an introduction of mechanical energy for breaking up the bonds provided by the molecular chains and an introduction of thermal energy for breaking down the molecular chains.

According to a further embodiment, the agglomerates can be introduced in the dried state together with grinding elements, especially grinding beads, into a grinding unit, which can be heated. According to a further embodiment, a rotary kiln can be used as the grinding unit. According to a further embodiment, the grinding elements can be separated from the ore particles of value by means of a separating device, especially a screen, arranged downstream of the grinding unit.

According to another embodiment, an apparatus for carrying out the above mentioned method, comprises a heatable grinding unit, into which the agglomerates, which consist of ore particles of value, especially $Cu_2S$, and magnetizable particles, especially $Fe_3O_4$, bonded to said ore particles by way of organic molecular chains, are charged together with grinding elements, in which the agglomerates are broken up by introduction of mechanical energy through the grinding elements and the molecular chains are broken down into the ground material in the grinding unit by introduction of thermal energy, as well as a device arranged downstream of the grinding unit for separating the grinding elements from the separated ore particles of value and magnetizable particles.

According to a further embodiment of the apparatus, the grinding unit may be a rotary kiln. According to a further embodiment of the apparatus, the separating device can be a screen. According to a further embodiment of the apparatus, arranged downstream of the separating device can be a magnetic separation device, for separating the magnetizable particles from the ore particles of value.

BRIEF DESCRIPTION OF THE DRAWINGS

Further advantages, features and details emerge from the exemplary embodiment described below and on the basis of the drawings, in which.

DETAILED DESCRIPTION

Figure 1:
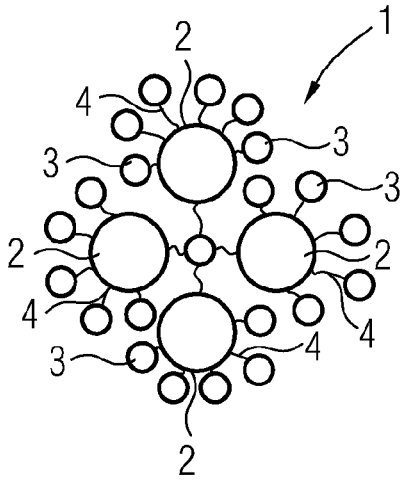
FIG. 1 shows a basic representation of an agglomerate containing $Cu_2S$ and $Fe_3O_4$, which are bonded by way of organic molecular chains.

According to various embodiments, the agglomerates undergo simultaneously both an introduction of mechanical energy for breaking up the bonds provided by the molecular chains and an introduction of thermal energy for breaking down the molecular chains.

After the hydrophobizing and separating of the agglomerates, that is for example the $Cu_2S/Fe_3O_4$ particles, have taken place, the agglomerate material is usually dried, so that virtually dry powder is available for carrying out the method according to various embodiments. To separate the two types of particle, the various embodiments provide a mechanical process and a thermal process, to which the particles are subjected simultaneously. For this purpose, the agglomerates are mechanically treated, in order by imparting mechanical energy to the particles bonded by way of the molecular chains, or to the complete agglomerates, to break up these chain bonds mechanically. At the same time, the agglomerate or powder material is heated, which has the effect that, to the extent to which they are exposed as a result of the mechanical treatment, the molecular chains are thermally broken down or destroyed, consequently therefore burned, and as a result can no longer lead to particle bonding. At the end of this combined mechanical and thermal treatment process, ore of value, that is to say for example $Cu_2S$, and magnetizable particles, for example $Fe_3O_4$, that is almost 100% free from molecular chains is obtained. The two particles can be separated by way of downstream process technology, which will be further discussed below.

As a result of the simultaneous introduction of mechanical and thermal energy, it is advantageously possible to break up the individual agglomerates almost completely and thermally break down the molecular chains that bring about the formation of the agglomerates, so that $Cu_2S$ and $Fe_3O_4$ particles that are, for example, "free from molecular chains", are obtained at the end of the process and can readily be separated. The temperature required for the thermal breaking-down, that is burning, of the molecular chains depends on the organic material used, added for the hydrophobization in the course of the upstream material treatment. The temperature should therefore be chosen according to the starting materials used; it may, for example, lie in a range of several 100° C., in order to ensure complete burning.

In order to break up the agglomerates mechanically, the agglomerate material is expediently ground, for which purpose the agglomerates are introduced in the dried state together with grinding elements, especially grinding beads, into a grinding unit, which can be heated for concomitantly supplying thermal energy. Therefore, a heatable grinding unit which offers the possibility of being able to supply mechanical and thermal energy simultaneously is used.

Even though in principle there is the possibility of using a discontinuously operating grinding unit, which is filled with agglomerates along with grinding elements, whereby the grinding operation is performed, after the completion of which the grinding unit is emptied and re-filled, and various embodiments provide using as the grinding unit a rotary kiln, which makes continuous operation possible. The rotary kiln is charged on one side with the agglomerates along with grinding elements, which "migrate" through the rotary kiln during the grinding operation and leave it at the other end. This means that particles to be worked continuously along with grinding elements are charged at one end and the worked, free substances along with the grinding elements are removed again at the other end. This allows working that is efficient and cost-effective, because continuous, to be achieved.

Arranged downstream of the grinding unit itself is a separating device, especially a screen, for separating the grinding elements from the then free particles, for example $Cu_2S$ and $Fe_3O_4$. This may be, for example, a vibrating screen, onto which the treated material, which is leaving the rotary kiln, falls along with grinding beads. The fine $Cu_2S$ and $Fe_3O_4$ falls through the vibrating screen, while the grinding beads remain above the vibrating screen, are collected by it and are fed once again to the rotary kiln along with not yet treated $Cu_2S/Fe_3O_4$ agglomerates.

The separated ore particles of value and magnetizable particles ($Cu_2S$ and $Fe_3O_4$ particles) can then be treated by any desired downstream process technology in order to separate the substances from one another. For example, the powder containing the two materials may be taken by means of a transporting belt into a magnetic field, by way of which for example the ferromagnetic $Fe_3O_4$ is separated from the $Cu_2S$. However, it would also be conceivable to perform instead of this "dry" separation a wet separation, by dissolving the powder in the water and passing it through a tubular reactor with magnetic separation. In any event, in this way up to at least 98% of the $Fe_3O_4$, that is the magnetite, for example can be recovered and used as an additive for the ground ore powder available at the beginning of the method.

Apart from the method, other embodiments also relates to an apparatus for carrying out the method. This comprises a heatable grinding unit, into which agglomerates, which consist of ore of value and magnetizable particles, especially $Fe_3O_4$, bonded to said ore by way of organic molecular chains, are charged together with grinding elements, in which the agglomerates are broken up by introduction of mechanical energy through the grinding elements and the molecular chains are broken down into the ground material in the grinding unit by introduction of thermal energy, as well as a device arranged downstream of the grinding unit for separating the grinding elements from the separated ore particles of value and magnetizable particles.

The grinding unit is expediently a rotary kiln, which makes continuous operation possible. The separating device which is connected downstream of the rotary kiln is expediently a screen, preferably a vibrating screen. Finally, the apparatus according to various embodiments also comprises a magnetic separation device, arranged downstream of the separating device, for separating the magnetizable particles from the $Cu_2S$.

FIG. 1 shows in the form of a basic representation an agglomerate 1, consisting in the example shown of four $Cu_2S$ particles 2 and, surrounding these, a multiplicity of ferromagnetic oxide components, here $Fe_3O_4$ particles 3, which are depicted as significantly smaller here for the sake of overall clarity. The $Cu_2S$ particles 2 and the $Fe_3O_4$ particles 3 are bonded to one another by way of longer organic molecular chains 4. This organic chain material was added together with the powdered $Fe_3O_4$ to the ore that was finely ground and pre-cleaned at the beginning of the extraction process, in order to hydrophobize both the, non-magnetic, $Cu_2S$ contained in the ground ore and the ferromagnetic $Fe_3O_4$ and to make it possible for $Fe_3O_4$ particles 3 to become attached to the $Cu_2S$ particles 2, in order that these agglomerates can be magnetically separated out from the other ground ore material. It is then necessary to break up these agglomerates again and to separate the $Cu_2S$ from the $Fe_3O_4$, which is intended to be used again for this upstream process. This takes place by simultaneously imparting mechanical and thermal action to the agglomerates 1 shown in FIG. 1, on the one hand to break up the agglomerates by introducing mechanical energy, that is to say to part or break up the molecular chains 4, and on the other hand to break down the molecular chains that are then exposed as a result of the mechanical breakup thermally, that is to burn them, by introducing thermal energy, that is by strong heating.

Figure 2:
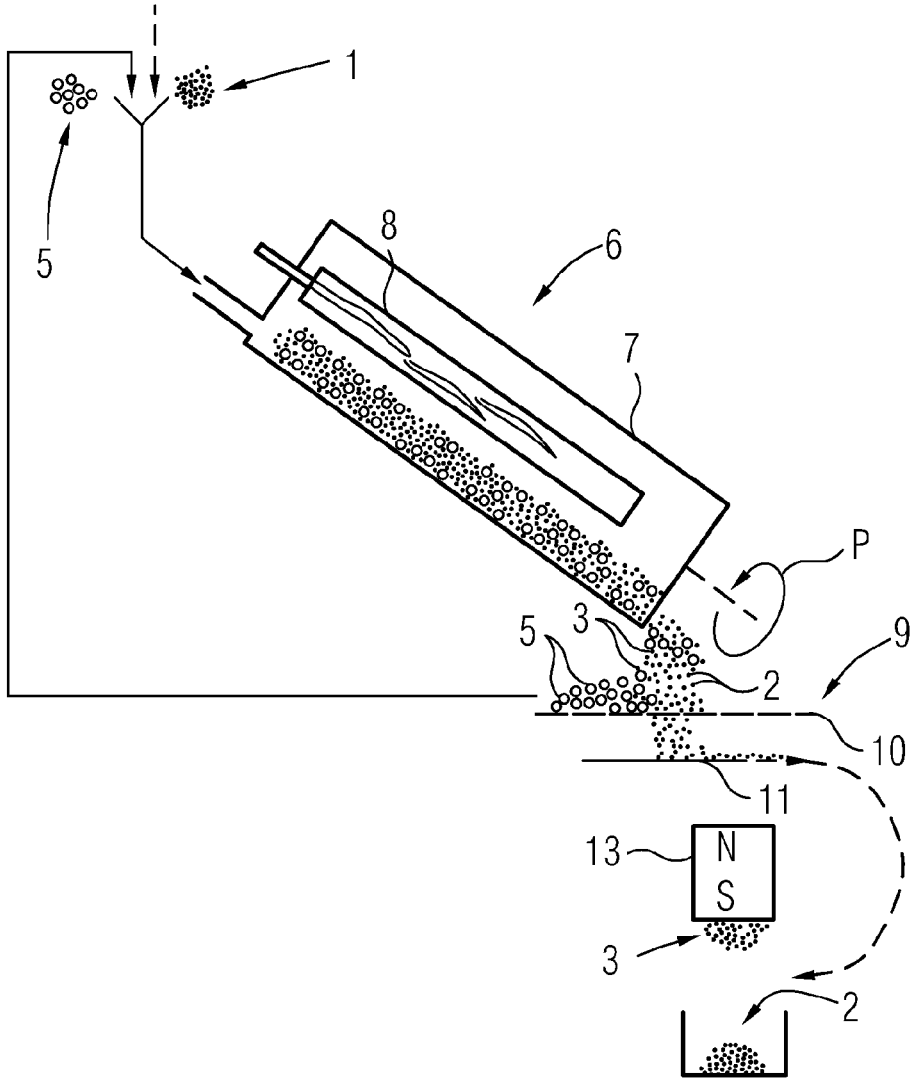
FIG. 2 shows a basic representation of an apparatus according to various embodiments for carrying out the method.

For this purpose, after drying, the agglomerates 1 present in powder form are introduced together with grinding elements, here in the form of grinding beads 5, into a grinding unit 6, here in the form of a rotary kiln 7, see FIG. 2. The rotary kiln 7 rotates continuously about its longitudinal axis, as represented by the arrow P. Provided inside the rotary kiln 7 is a heating device 8, which here is fired, for example, by combustible gas, that is to say it is possible to heat the interior of the rotary kiln 7 strongly.

In the rotating rotary kiln 7, the grinding beads 5 then grind the agglomerates 1, that is they break the chain bond by introducing mechanical energy during the time in which the grinding beads 5 and the particles 1 are in the rotary kiln 7. As a result of the strong heating by the heating device 8, concomitantly the exposed molecular chains 4 are thermally broken down, that is to say burned. At the opposite end of the rotary kiln 7, the grinding beads 5 and the then free, separated $Cu_2S$ particles 2 and the $Fe_3O_4$ particles 3 then leave the furnace and fall onto a separating device 9, here in the form of a vibrating screen 10, on which the grinding beads 5 remain, while the $Cu_2S$ particles 2 and the $Fe_3O_4$ particles 3 fall through the vibrating screen 10 and are transported away by means of a transporting device 11, for example a transporting belt, and are brought into the region of a downstream magnetic separation device 12, where they are separated from one another by means of a magnet 13. The ferromagnetic $Fe_3O_4$ particles 3 remain on the magnet, while the $Cu_2S$ articles 2 are collected separately from them.

It is evident that the rotary kiln 7 allows continuous working, since it can be continuously charged with fresh particulate material to be worked along with grinding beads, while at the end of the furnace the then separated particles along with grinding beads can be continuously drawn off and passed on for further use.

What is claimed is:

1. A method for removing ore particles of value from agglomerates which contain ore particles of value and magnetizable particles attached thereto by way of organic molecular chains in the course of a process for extracting the ore of value from crude ore, after a magnetic separation and extraction of the agglomerates from remaining components of the crude ore, the method comprising:

adding grinding elements to a quantity of the valuable ore particle/magnetizable particle agglomerates to form a mixture;

applying mechanical energy to the mixture for breaking up the bonds provided by the molecular chains in the agglomerates by agitation with the grinding elements;

applying heat from an external source to the mixture for breaking down the molecular chains by thermal energy; and sorting the valuable ore particles from the magnetizable particles and the grinding elements.

2. The method according to claim 1, wherein the agglomerates are introduced in the dried state together with the grinding elements into a grinding unit, which can be heated.

3. The method according to claim 2, wherein a rotary kiln is used as the grinding unit.

4. The method according to claim 2, wherein the grinding elements are sorted from the ore particles of value by means of a separating device arranged downstream of the grinding unit.

5. The method according to claim 4, wherein the separating device includes a screen.

6. The method according to claim 1, wherein the magnetizable particles are $Fe_3O_4$.

7. The method according to claim 1, wherein the grinding elements comprise grinding beads.

* * * * *